US009441878B2

(12) United States Patent
Howard

(10) Patent No.: US 9,441,878 B2
(45) Date of Patent: Sep. 13, 2016

(54) AIR SEPARATION APPARATUS

(71) Applicant: Henry Edward Howard, Grand Island, NY (US)

(72) Inventor: Henry Edward Howard, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

(21) Appl. No.: 14/994,637

(22) Filed: Jan. 13, 2016

(65) Prior Publication Data

US 2016/0123661 A1 May 5, 2016

Related U.S. Application Data

(62) Division of application No. 12/727,442, filed on Mar. 19, 2010, now Pat. No. 9,279,613.

(51) Int. Cl.
*F25J 3/04* (2006.01)

(52) U.S. Cl.
CPC ..... *F25J 3/04012* (2013.01); *F25J 3/0409* (2013.01); *F25J 3/04018* (2013.01); *F25J 3/0423* (2013.01); *F25J 3/04163* (2013.01); *F25J 3/04303* (2013.01); *F25J 3/04412* (2013.01); *F25J 3/04424* (2013.01); *F25J 3/04654* (2013.01); *F25J 3/04666* (2013.01); *F25J 3/04672* (2013.01); *F25J 3/04678* (2013.01); *F25J 3/04709* (2013.01); *F25J 3/04715* (2013.01); *F25J 3/04721* (2013.01);
(Continued)

(58) Field of Classification Search
CPC .... F25J 3/0409; F25J 3/04303; F25J 3/0423; F25J 3/04412; F25J 3/04672; F25J 3/04678; F25J 2270/02; F25J 3/04466; F25J 3/0466; F25J 3/04709; F25J 3/04727; F25J 3/0479; F25J 3/04654; F25J 3/28; F25J 3/0285; F25J 2200/08; F25J 2200/32; F25J 2200/44; F25J 2215/58; F25J 2260/58; F25J 3/043
See application file for complete search history.

(56) References Cited

U.S. PATENT DOCUMENTS 4,670,031 A 6/1987 Erickson
5,076,823 A * 12/1991 Hansel ..... B01J 19/32 62/651

(Continued)

FOREIGN PATENT DOCUMENTS

CN 101501431 B 1/2013
EP 0 776 685 A1 6/1997
WO WO 2008/112728 A2 9/2008

*Primary Examiner* — Frantz Jules
*Assistant Examiner* — Brian King
(74) *Attorney, Agent, or Firm* — Robert J. Hampsch; David M. Rosenblum

(57) ABSTRACT

A cryogenic air separation method and apparatus in which first and second liquid streams are produced. The first liquid stream has a higher oxygen content than air and can consist of a higher pressure distillation column bottoms and the second liquid stream, for instance, air, has a lower oxygen content than the first liquid stream and an argon content no less than the air. The second liquid stream is subcooled through indirect heat exchange with the first liquid stream and both of such streams are introduced into the lower pressure column. The second liquid stream is introduced into the lower pressure column above that point at which the crude liquid oxygen column bottoms or any portion thereof is introduced into the lower pressure column to increase a liquid to vapor ratio below the introduction of the second liquid stream and therefore, reduce the oxygen present within the column overhead.

6 Claims, 5 Drawing Sheets

(52) U.S. Cl.
CPC ..... *F25J 2200/54* (2013.01); *F25J 2210/58* (2013.01); *F25J 2215/40* (2013.01); *F25J 2220/40* (2013.01); *F25J 2250/20* (2013.01); *F25J 2250/40* (2013.01); *F25J 2250/52* (2013.01); *F25J 2270/02* (2013.01); *F25J 2290/34* (2013.01)

(56) References Cited

U.S. PATENT DOCUMENTS 5,114,449 A 5/1992 Agrawal et al.
5,255,524 A 10/1993 Agrawal et al.
5,546,766 A * 8/1996 Higginbotham ..... F25J 3/0409 62/645
5,586,451 A 12/1996 Koeberle et al.
5,682,765 A 11/1997 Lynch et al.
5,692,396 A 12/1997 Rathbone
5,784,899 A 7/1998 Nojima et al.
5,893,276 A 4/1999 Higginbotham
7,549,301 B2 6/2009 Howard
2008/0307828 A1 12/2008 Prosser et al.

* cited by examiner

AIR SEPARATION APPARATUS

CROSS REFERENCE TO RELATED APPLICATIONS

The present application is a divisional application and claims the benefit of and priority to U.S. patent application Ser. No. 12/727,442 filed on Mar. 19, 2010.

FIELD OF THE INVENTION

The present invention relates to a method and apparatus for separating air in which compressed and purified air is distilled within a distillation column unit and a liquid feed to the distillation column unit is subjected to enhanced subcooling whereby the oxygen and/or argon recovery of the lower pressure column of the distillation column unit is increased by way of increased liquid to vapor ratio below the liquid feed location.

BACKGROUND

Air is separated into its component parts by distillation that is conducted in air separation plants. Such plants employ a main air compressor to compress the air, a prepurfication unit to remove higher boiling contaminants from the air, such as carbon dioxide, water vapor and hydrocarbons, and a main heat exchanger to cool the resulting compressed and purified air to a cryogenic temperature suitable for its distillation within a distillation column unit. The distillation column unit employs a higher pressure column, a lower pressure column and optionally an argon column when argon is a desired product.

The compressed air is introduced into the higher pressure column and is rectified into a crude liquid oxygen column bottoms, also known as kettle liquid, and a nitrogen-rich vapor column overhead. A stream of the crude liquid oxygen is introduced into the lower pressure column for further refinement into an oxygen-rich liquid column bottoms and a nitrogen-rich vapor column overhead. The lower pressure column operates at a lower pressure to enable the oxygen-rich liquid to condense at least part of the nitrogen-rich vapor column overhead of the higher pressure column for purposes of refluxing both columns and for production of nitrogen products from the condensate. Streams of the oxygen-rich liquid, nitrogen-rich vapor and condensed nitrogen-rich vapor can be introduced into the main heat exchanger to help cool the air and warmed to produce oxygen and nitrogen products.

Where argon is a desired product, an argon column can be connected to the lower pressure column to rectify a stream of an argon and oxygen containing vapor removed from the lower pressure column. Furthermore, when an oxygen and/or a nitrogen product is desired at high pressure, potentially a supercritical pressure, a stream of the oxygen-rich liquid produced as column bottoms in the lower pressure column and/or a stream of nitrogen-rich liquid produced as condensate can be pumped and then heated in a heat exchanger to produce a high pressure vapor or a supercritical fluid. Typically, the heat exchange duty for such purposes is provided by further compressing part of the air in a booster compressor after the air has been compressed in the main air compressor. The resulting boosted pressure air stream is liquefied and the liquid air stream can be introduced into either the higher pressure column or the lower pressure column or both of such columns.

As can be appreciated, the degree to which oxygen is present within the column overhead of the lower pressure column depends primarily upon the reflux ratio within the upper sections of lower pressure column. As reflux ratio (L/V) is increased a greater proportion of the oxygen and argon will be extracted from the lower pressure column at a lower level (eventually recovered as product oxygen or argon). Typically, in plants employing a pump to pressurize a product with resulting liquefied air, at least a portion of the liquid air is introduced into the lower pressure column above the location or locations at which the crude liquid oxygen is introduced. This introduction of liquid air increases the liquid to vapor ratio below the point of introduction to that L/V which would have existed relative to the top of the column or that which would have existed if the liquid air was not fed to the upper column. This decreases the amount of oxygen within the column overhead of the lower pressure column and in turn increases oxygen recovery.

As will be discussed, the present invention provides a method and apparatus for separating air in which a subcooled liquid is produced that has both an oxygen and a nitrogen content and argon content that is no less than air and such subcooled liquid is introduced into the lower pressure column above a region thereof at which the crude liquid oxygen is introduced to decrease the degree to which oxygen is present within the overhead of the lower pressure column to an extent that is greater than conventionally obtained by the introduction of liquid air as in the prior art.

SUMMARY OF THE INVENTION

The present invention, in one aspect, provides an air separation method in which a cryogenic rectification process is conducted that comprises distilling compressed and purified air into at least a nitrogen-rich fraction and oxygen-rich fraction within a distillation column unit having at least a higher pressure column and a lower pressure column. The lower pressure column is operatively associated with the higher pressure column in a heat transfer relationship and is connected to the higher pressure column such that a crude liquid oxygen column bottoms produced in the higher pressure column is introduced into and further refined in the lower pressure column.

The cryogenic rectification process is conducted such that a first liquid stream and a second liquid stream are produced that contain oxygen and nitrogen. The first liquid stream has higher oxygen content than the air and the second liquid stream has lower oxygen content than the first liquid stream and argon content no less than the air after purification. The second liquid stream is subcooled through indirect heat exchange with the first liquid stream and the second liquid stream is introduced into the lower pressure column at a column location above that at which the crude liquid oxygen column bottoms or any portion thereof is introduced into the lower pressure column. As a result, the liquid to vapor ratio below the column location into which the second liquid stream is introduced is increased and therefore, oxygen present within the column overhead is reduced and oxygen recovery of distillation column unit is increased.

As a result of the method of the present invention, oxygen production is increased since the oxygen present within the column overhead is reduced. This reduction will be greater than in the prior art given that the second liquid stream is in a subcooled state. In the prior art, the introduction of liquid air is accompanied by expanding the liquid air. The subcooling of the second liquid stream, that can also be composed of liquid air, decreases the degree to which vapor will be evolved from expansion and introduction of such stream into the lower pressure column. Therefore, the liquid to vapor ratio within the lower pressure column is increased over the prior art and the degree to which liquid oxygen and argon is driven into the descending liquid phase is increased. As a result, oxygen recovery will be increased over that contemplated by prior art methodology. Moreover, if argon is a desired product, the distillation column unit is provided with an argon column connected to the lower pressure column such that an oxygen and argon containing vapor stream is introduced into the argon column and argon is separated from the oxygen to produce an argon-rich fraction that is utilized in producing an argon product. An argon condenser is provided to condense an argon-rich vapor stream composed of the argon-rich fraction for purposes of producing the argon product and column reflux. The introduction of the second liquid stream, after having been subcooled, into the lower pressure column reduces the argon within the column overhead of the lower pressure column. In so doing, an increased accumulation of argon is found within the lower sections of the lower pressure column. As a consequence, the rate at which the oxygen and argon containing vapor stream is able to be extracted from the lower pressure column is increased. Since the argon recovered from the distillation column unit is proportional to this contained argon the overall recovery of argon from the distillation column unit is increased. It is to be noted that the term "cryogenic rectification process" as used herein and in the claims means any process that includes, but is not limited to, compressing and purifying the air and then cooling the air to a temperature suitable for its rectification within an air separation unit having a higher pressure column, a lower pressure column and optionally an argon column and further, imparting refrigeration into the process in some manner, such as through turboexpansion of air. Such process can include the production of pressurized products by heating a pumped oxygen-enriched and optionally a nitrogen-enriched stream through indirect heat exchange with a boosted pressure air stream that is liquefied as a result of the heating. Furthermore, the term "cryogenic rectification plant" as used herein and in the claims means any plant having components to conduct such a cryogenic rectification process, that include, but are not limited to, a main air compressor, a pre-purification unit, a main heat exchanger, a distillation column unit having higher and lower pressure columns and optionally an argon column, a means for creating refrigeration such as a turboexpander, one or more pumps when pressurized products are required and booster compressors for compressing the air to heat resulting pumped streams.

The cryogenic rectification process is conducted such that a crude liquid oxygen stream composed of the crude liquid oxygen column bottoms of the higher pressure column is subcooled and constitutes the crude liquid oxygen column bottoms that is introduced into and further refined in the lower pressure column. At least part of a component-rich stream, enriched in a component of the air, for instance oxygen and/or nitrogen is pumped to form a pumped liquid stream and at least part of the pumped liquid stream is heated though indirect heat exchange with a boosted pressure air stream, thereby to produce a pressurized product stream from the pumped liquid stream and a liquid air stream from the boosted pressure air stream.

The first liquid stream can be formed from part of the crude liquid oxygen stream and a remaining part of the crude liquid oxygen stream can be valve expanded and introduced into the lower pressure column. The second liquid stream can be formed from at least part of the liquid air stream. The first liquid stream is valve expanded prior to subcooling the second liquid stream and the second liquid stream is valve expanded and introduced into the lower pressure column above the remaining part of the crude liquid oxygen stream. In a specific embodiment of the foregoing, the first liquid stream after having been valve expanded is introduced into the argon condenser and indirectly exchanges heat with the argon-rich vapor stream and the second liquid stream thereby condensing the argon-rich vapor stream, subcooling the second liquid stream and producing a liquid phase and a vapor phase from the first liquid stream. Liquid and vapor phase streams composed of the liquid phase and the vapor phase, respectively, are introduced into the lower pressure column. In an alternative specific embodiment, the second liquid stream is subcooled through indirect heat exchange with the first liquid stream within a heat exchanger. The first liquid stream after having passed through the heat exchanger is introduced into the argon condenser and indirectly exchanges heat with the argon-rich vapor stream, thereby condensing the argon-rich vapor stream and producing a liquid phase and a vapor phase from the first liquid stream. A liquid phase stream and a vapor phase stream composed of the liquid phase and the vapor phase, respectively, are introduced into the lower pressure column.

In another alternative embodiment, the first liquid stream is formed from part of the crude liquid oxygen stream and a remaining part of the crude liquid oxygen stream is valve expanded and introduced into the lower pressure column. The liquid air stream is valve expanded and introduced into the higher pressure column and the second liquid stream is removed from the higher pressure column at a column level at which the liquid air stream is introduced into the higher pressure column. The second liquid stream is subcooled through indirect heat exchange with the first liquid stream after having been valve expanded within a heat exchanger and the second liquid stream after having been subcooled is valve expanded and introduced into the lower pressure column above the remaining part of the crude liquid oxygen. The first liquid stream after having passed through the heat exchanger is introduced into the argon condenser and indirectly exchanges heat with an argon-rich vapor stream, thereby condensing the argon-rich vapor stream and producing a liquid phase and a vapor phase from the first liquid stream. A liquid phase stream and a vapor phase stream composed of the liquid phase and the vapor phase, respectively, are introduced into the lower pressure column.

In yet another alternative embodiment, part of the crude liquid oxygen stream is valve expanded and then introduced into the argon condenser and indirectly exchanges heat with the argon-rich vapor stream produced as a column overhead of the argon column thereby condensing the argon-rich vapor stream and producing a liquid phase and a vapor phase from the first liquid stream. A remaining part of the crude liquid oxygen stream is valve expanded and introduced into the lower pressure column and a vapor phase stream composed of the vapor phase is introduced into the lower pressure column. The first liquid stream is formed by a liquid phase stream composed of the liquid phase and the second liquid stream is formed from at least part of the liquid air stream. The second liquid stream is valve expanded and subcooled through indirect heat exchange with the first liquid stream in a heat exchanger and the second liquid stream, after having been subcooled, is valve expanded and introduced into the lower pressure column above the remaining part of the crude liquid oxygen stream.

In yet still a further embodiment, the liquid air stream is valve expanded and introduced into the higher pressure column and the second liquid stream is removed from the higher pressure column at or below a higher pressure column level at which the liquid air is introduced. The first liquid stream is removed from the lower pressure column, valve expanded and indirectly exchanges heat with the second liquid stream within a heat exchanger, thereby to subcool the second liquid stream. The first liquid stream is passed from the heat exchanger into the argon condenser and indirectly exchanges heat with the argon-rich vapor stream produced as a column overhead of the argon column thereby condensing the argon-rich vapor stream and producing a liquid phase and a vapor phase from the first liquid stream. A liquid phase stream and a vapor phase stream, composed of the liquid phase and the vapor phase, respectively, are introduced into the lower pressure column at or below a lower pressure column level from which the first liquid stream is removed from the lower pressure column. The second liquid stream, after having been subcooled is valve expanded and introduced into the lower pressure column at the column location that is situated above the introduction of crude liquid oxygen column bottoms stream.

In another aspect, the present invention provides an air separation apparatus that comprises a cryogenic rectification plant. The cryogenic rectification plant comprises a distillation column unit having at least a higher pressure column and a lower pressure column configured to distill compressed and purified air into at least a nitrogen-rich fraction and oxygen-rich fraction. The lower pressure column is operatively associated with the higher pressure column in a heat transfer relationship and connected to the higher pressure column such that a crude liquid oxygen column bottoms produced in the higher pressure column is introduced into and further refined in the lower pressure column. The cryogenic rectification plant has means for producing a first liquid stream, and means for producing a second liquid stream. The first liquid stream and the second liquid stream both contain oxygen and nitrogen, the first liquid stream has a higher oxygen content than the air and the second liquid stream has a lower oxygen content than the first liquid stream and an argon content no less than the air after purification. Also provided are first means for subcooling the crude liquid oxygen column bottoms to be further refined in the lower pressure column and second means for subcooling the second liquid stream through indirect heat exchange with the first liquid stream. The second subcooling means is connected to the lower pressure column such that the second liquid stream is introduced into the lower pressure column into a column above that at which the crude liquid oxygen column bottoms or any portion thereof is introduced into the lower pressure column so that a liquid to vapor ratio below the column location into which the second liquid stream is introduced is increased and therefore, oxygen present within the column overhead is reduced in the lower pressure column and oxygen recovery of the oxygen-rich fraction is increased within the lower pressure column.

The cryogenic rectification plant can be a pumped liquid oxygen plant and as such be provided with a pump connected to the air separation unit such that at least part of a component-rich stream, enriched in a component of the air, is pumped to form a pumped liquid stream. Main heat exchange means are connected to the air separation unit for cooling the air and heating at least part of the pumped liquid stream though indirect heat exchange with a boosted pressure air stream, thereby to produce a pressurized product stream from the pumped liquid stream and a liquid air stream from the boosted pressure air stream. The first subcooling means is configured to subcool a crude liquid oxygen stream composed of the crude liquid oxygen column bottoms to be further refined in the lower pressure column and the distillation column unit can be provided with an argon column. The argon column is connected to the lower pressure column such that an oxygen and argon containing vapor stream is introduced into the argon column and argon is separated from the oxygen to produce an argon-rich vapor stream. An argon condenser is configured to condense the argon-rich vapor stream, return column reflux to the argon column and to produce an argon product stream. The second subcooling means can be connected to the first subcooling means such that the first liquid stream is formed from part of the crude liquid oxygen stream and to the main heat exchange means such that the second liquid stream is formed from at least part of the liquid air stream. The first subcooling means is connected to the lower pressure column such that a remaining part of the crude liquid oxygen stream is introduced into the lower pressure column. The lower pressure column connected to the second subcooling means such that the second liquid stream is introduced into the lower pressure column above the remaining part of the crude liquid oxygen stream. First, second and third expansion valves are respectively positioned: between the lower pressure column and the first subcooling means such that the remaining part of the crude liquid oxygen stream is valve expanded prior to introduction into the lower pressure column; the second subcooling means and the first subcooling means such that the first subsidiary crude liquid oxygen stream is valve expanded prior to entering the second subcooling means; and between the second subcooling means and the lower pressure column such that the second liquid stream is valve expanded prior to being introduced into the lower pressure column.

The second subcooling means can be the argon condenser and in such case, the argon condenser is configured such that the first liquid stream is introduced into an argon condenser and indirectly exchanges heat with the argon-rich vapor stream and the second liquid stream thereby condensing the argon-rich vapor stream, subcooling the second liquid stream and producing a liquid phase and a vapor phase from the first liquid stream. The argon condenser is connected to the lower pressure column such that a liquid phase stream and a vapor phase stream composed of the liquid phase and the vapor phase, respectively, are introduced into the lower pressure column. Alternatively, the second subcooling means can be a heat exchanger and the argon condenser is connected to the heat exchanger such that the first liquid stream after having passed through the heat exchanger is introduced into the argon condenser and indirectly exchanges heat with an argon-rich vapor stream produced as a column overhead of the argon column thereby condensing the argon-rich vapor stream and producing a liquid phase and a vapor phase from the first liquid stream. The argon condenser is connected to the lower pressure column such that a liquid phase stream and a vapor phase stream composed of the liquid phase and the vapor phase, respectively, are introduced into the lower pressure column.

In a further alternative, second subcooling means is a heat exchanger connected to the first subcooling means such that the first liquid stream is formed from part of the crude liquid oxygen stream and the first subcooling means is connected to the lower pressure column such that a remaining part of the crude liquid oxygen stream is valve expanded and introduced into the lower pressure column. The higher pressure column is connected to the main heat exchange means such that the liquid air stream is introduced into the higher pressure column and the heat exchanger is connected to the higher pressure column such that the second liquid stream is removed from the higher pressure column at a column level at which the liquid air stream is introduced into the higher pressure column. The lower pressure column is connected to the heat exchanger such that the second liquid stream after having been subcooled is introduced into the lower pressure column above the remaining part of the crude liquid oxygen. The argon condenser is connected to the heat exchanger such that the first liquid stream after having passed through the heat exchanger is introduced into an argon condenser and indirectly exchanges heat with the argon-rich vapor stream thereby condensing the argon-rich vapor stream and producing a liquid phase and a vapor phase from the first liquid stream. The argon condenser is connected to the lower pressure column such that a liquid phase stream and a vapor phase stream composed of the liquid phase and the vapor phase, respectively, are introduced into the lower pressure column. First, second, third and fourth expansion valves respectively positioned: between the lower pressure column and the first subcooling means such that the remaining part of the crude liquid oxygen stream is valve expanded prior to introduction into the lower pressure column; the heat exchanger and the first subcooling means such that the first liquid stream is valve expanded prior to entering the heat exchanger; between and the heat exchanger and the lower pressure column such that the second liquid stream is valve expanded prior to being introduced into the lower pressure column; and between the main heat exchange means and the higher pressure column such that the liquid air stream is expanded prior to entering the higher pressure column.

In yet another alternative, the argon condenser is connected to the first subcooling means such that part of the crude liquid oxygen stream is introduced into an argon condenser and indirectly exchanges heat with an argon-rich vapor stream thereby condensing the argon-rich vapor stream and producing a liquid phase and a vapor phase from the first liquid stream. The lower pressure column is connected to the first subcooling means such that a remaining part of the crude liquid oxygen stream is introduced into the lower pressure column and the argon condenser is connected to the lower pressure column such that a vapor phase stream composed of the vapor phase is introduced into the lower pressure column. The second subcooling means is a heat exchanger connected to the argon condenser such that the first liquid stream is formed by a liquid phase stream composed of the liquid phase and also to the main heat exchange means such that the second liquid stream is formed from at least part of the liquid air stream. The lower pressure column is connected to the heat exchanger such that the second liquid stream, after having been subcooled, is introduced into the lower pressure column above the remaining part of the crude liquid oxygen stream. First, second, third and fourth expansion valves are respectively positioned: between the lower pressure column and the first subcooling means such that the remaining part of the crude liquid oxygen stream is valve expanded prior to introduction into the lower pressure column; the heat exchanger and the first subcooling means such that the first liquid stream is valve expanded prior to entering the heat exchanger; between and the heat exchanger and the lower pressure column such that the second liquid stream is valve expanded prior to being introduced into the lower pressure column; and between the main heat exchange means and the heat exchange means such that the at least part of the liquid air stream is expanded prior to entering the heat exchanger.

In a further alternative, the main heat exchange means is connected to the higher pressure column such that the liquid air stream is introduced into the higher pressure column. The second subcooling means is a heat exchanger connected to the higher pressure column and the lower pressure column such that the second liquid stream is removed from the higher pressure column at or below a higher pressure column level at which the liquid air stream is introduced into the higher pressure column, the first liquid stream is removed from the lower pressure column and the second liquid stream, after having been subcooled is introduced into the lower pressure column above the introduction of the crude liquid oxygen column bottoms stream. The argon condenser is connected to the heat exchanger such that the first liquid stream is passed from the heat exchanger into the argon condenser and indirectly exchanges heat with an argon-rich vapor stream, thereby condensing the argon-rich vapor stream and producing a liquid phase and a vapor phase from the first liquid stream. The argon condenser is in turn connected to the lower pressure column such that a liquid phase stream and a vapor phase stream, composed of the liquid phase and the vapor phase, respectively, are introduced into the lower pressure column at or below a lower pressure column level at which the first liquid stream is removed from the lower pressure column. First, second, third and fourth expansion valves respectively positioned: between the lower pressure column and the first subcooling means such that the remaining part of the crude liquid oxygen stream is valve expanded prior to introduction into the lower pressure column; the heat exchanger and the lower pressure column such that the first liquid stream is valve expanded prior to entering the heat exchanger; between and the heat exchanger and the lower pressure column such that the second liquid stream is valve expanded prior to being introduced into the lower pressure column; and between the main heat exchange means and the higher pressure column such that the at least part of the liquid air stream is valve expanded prior to entering the high pressure column.

BRIEF DESCRIPTION OF THE DRAWINGS

While the specification concludes with claims distinctly pointing out the subject matter that Applicant regards as his invention, it is believed that the invention will be better understood when taken in connection with the accompanying drawings in which:

In order to avoid needless repetition of explanation, the same reference numbers will be used for such elements that have the same function in the various embodiments of the present invention illustrated in the Figures.

DETAILED DESCRIPTION

Figure 1:
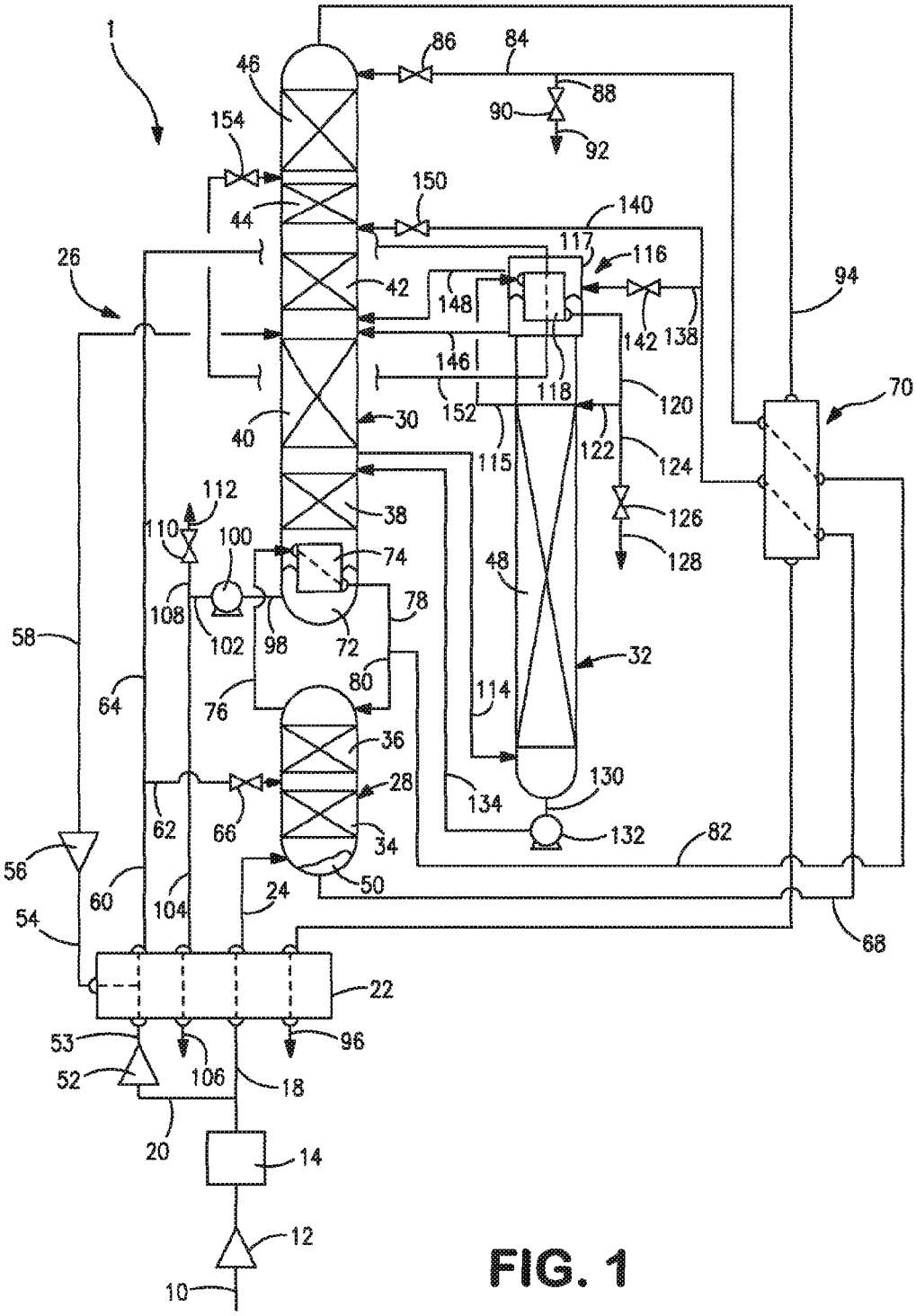
FIG. 1 is a schematic diagram of an air separation apparatus for carrying out a method in accordance with the present invention in which the argon condenser associated with the argon column is configured for use as a subcooling apparatus that is employed in subcooling a liquid stream that is introduced into the lower pressure column of the apparatus for decreasing oxygen and argon content within the column overhead of such column.

With reference to FIG. 1, an air separation apparatus 1 is illustrated that is designed to conduct a cryogenic rectification process to produce both a pressurized oxygen product and an argon product. The present invention is not, however, limited to such an apparatus and has more general application to any such apparatus that is designed to produce an oxygen product, with or without an argon product.

As will be discussed, in air separation apparatus 1, a crude liquid oxygen column bottoms of the higher pressure column, also known as kettle liquid, is further refined in the lower pressure column by subcooling a stream of such bottoms liquid and then introducing such stream into the lower pressure column. Part of the stream can be used to condense argon in an argon condenser associated with an argon column and then introduced into the lower pressure column as liquid and vapor phase streams. In accordance with the present invention, a first liquid stream that is composed of the crude liquid oxygen or other stream having a higher oxygen content than air is used to subcool a second liquid stream that is a liquid air stream or as will be discussed with respect to other embodiments, a synthetic liquid air stream containing oxygen and nitrogen and having a lower oxygen content than the first liquid stream and an argon concentration no less than air. The second liquid stream is subcooled and then introduced into the lower pressure column at a location above the crude liquid oxygen to increase the liquid to vapor ratio within the lower pressure column. The effect of this is to drive the oxygen and also, the argon into the liquid phase descending in such column to increase the oxygen within the oxygen-rich liquid column bottoms produced in the lower pressure column and also, the oxygen recovery. Where argon is a desired product, more argon will also be introduced into the argon column to also increase argon recovery. It is also to be mentioned that although the present invention is discussed with respect to a pumped liquid oxygen plant where in fact argon is a desired product, the present invention could be applied by removing first and second liquid streams having the aforementioned oxygen, nitrogen and argon contents from suitable column locations, subcooling the second liquid stream through indirect heat exchange with the first liquid stream and then introducing the second liquid stream into the lower pressure column to increase the liquid to vapor ratio in a column section or sections below its point of introduction to drive the oxygen into the liquid phase descending within the lower pressure column.

More specifically, in air separation apparatus 1, the first liquid stream is composed of the crude liquid oxygen and the second liquid stream is composed of liquid air. In air separation apparatus 1, a feed air stream 10 is compressed by a compressor 12 and then purified within a purification unit 14. Compressor 12 can be a multi-stage machine with intercoolers between stages and an after-cooler to remove the heat of compression from the final stage. Although not illustrated, a separate after-cooler could be installed directly downstream of compressor 12. Prepurification unit 14 as well known to those skilled in the art can contain beds of adsorbent, for example alumina or carbon molecular sieve-type adsorbent to adsorb the higher boiling impurities contained within the air and therefore feed air stream 10. For example such higher boiling impurities as well known would include water vapor and carbon dioxide that will freeze and accumulate at the low rectification temperatures contemplated by air separation apparatus 1. In addition, hydrocarbons can also be adsorbed that could collect within oxygen-rich liquids and thereby present a safety hazard.

The resulting compressed and purified air stream 16 is then divided into first and second subsidiary compressed and purified air streams 18 and 20. First subsidiary compressed and purified air stream 18 is cooled to near saturation within a main heat exchanger 22. It is to be noted that although main heat exchanger 22 is illustrated as a single unit, as would be appreciated by those skilled in the art, exact means for cooling the air and for conducting other heat exchange operations could differ from that illustrated. Typically, the means utilized would consist of two or more heat exchangers connected in parallel and further, each of such heat exchangers could be split in segments at the warm and cold ends thereof. Furthermore, the heat exchangers could further be divided in a banked design in which the heat exchange duty required at high pressures, for example between a boosted pressure air stream 53 and a first part 104 of at least part of a pumped liquid stream 102, both to be discussed, is conducted in one or more high pressure heat exchangers and other heat exchange duty that is to be conducted at lower pressures is conducted in a lower pressure heat exchanger, for example, first subsidiary compressed and purified air stream 18 and nitrogen-rich vapor stream 94, also to be discussed. All of such heat exchangers can be of plate-fin design and incorporate braised aluminum construction. Spiral wound heat exchangers are a possible construction for the higher pressure heat exchangers.

The resulting compressed, purified and cooled stream 24 is then introduced into an air separation unit 26 having higher and lower pressure columns 28 and 30 and an argon column 32. Specifically, compressed, purified and cooled stream 24 is introduced into the higher pressure column 28 that operates at a pressure of between about 5 and about 6 bar(a) and is so designated as "higher" in that it operates at a higher pressure than the lower pressure column 30 that is designated as "lower" in that it operates at a lower pressure than the higher pressure column 28. Higher pressure column 28 is provided with mass transfer contacting elements generally shown by reference numbers 34 and 36 that are used to contact an ascending liquid phase of the mixture to be separated, air, with a descending liquid phase. As the vapor phase ascends within the column it becomes richer in nitrogen to produce a nitrogen-rich vapor column overhead and a crude liquid oxygen column bottoms 50, also known as kettle liquid, that will be further refined in the lower pressure column 30. The mass transfer elements may be comprised of structured packing, trays, random packing or a combination of such elements. Lower pressure column 30 is provided with such mass transfer elements generally indicated by reference numbers 38, 40, 42, 44 and 46 and argon column 32 is also provided by mass transfer elements generally indicated by reference number 48.

Second subsidiary compressed air stream 20 is further compressed in a booster compressor 52 to produce a boosted pressure air stream 53 that is introduced into main heat exchanger 22. Boosted pressure air stream 53 constitutes between about 30 percent and about 40 percent of the total air entering the air separation apparatus 1. A first part 54 of the boosted pressure air stream 53 is removed from the main heat exchanger 22 after a partial traversal thereof and is expanded in an expansion turbine 56 to generate refrigeration by production of an exhaust stream 58 at a pressure of between about 1.1 and about 1.5 bar(a) that is introduced into the lower pressure column 30. Typically, first part 54 of boosted pressure air stream 53 constitutes between about 10 percent and about 20 percent of the boosted pressure air stream 53. It should be noted that the shaft work of expansion may be imparted to the compression of the expansion stream or used for purposes of compressing another process stream or generating electricity. As known in the art, refrigeration must be imparted into an air separation plant for such purposes as compensating for warm end losses in the heat exchangers, heat leakage into the plant and to produce liquids. Other means are also known in the art to produce such refrigeration such as introducing turbine exhaust into the higher pressure column, nitrogen expansion of a nitrogen-rich stream taken from the lower pressure column after the partial warming thereof as well as other expansion cycles known in the art. A second or remaining part of the boosted pressure air stream 53 upon cooling within the main heat exchanger 22 forms a liquid air stream 60 that has a temperature in a range of between about 98 and about 105K. It is to be noted that the first part 54 of the boosted pressure air stream could be produced by removing a stream from booster compressor 52 at an intermediate stage and then further compressing such stream. The second boosted pressure air stream 53 could then be introduced into the main heat exchanger 22 and fully traverse the same. In any event, the term "boosted pressure air stream" as used in the claims means any high pressure air stream that serves to heat a pumped liquid oxygen stream and can be formed in any conventional manner. Liquid air stream 60 is subsequently divided into a first part 62 and a second part 64. First part 62 of liquid air stream is valve expanded by expansion valve 66 and introduced into higher pressure column 28 and the second part 64 forms the second liquid stream for purposes of increasing the liquid to vapor ratio in the lower pressure column.

A crude liquid oxygen stream 68 composed of the crude liquid oxygen column bottoms 50 is subcooled in a subcooling unit 70 and further refined in the lower pressure column 30 in a manner that will also be discussed hereinafter. In this regard, subcooling unit 70 constitutes a first subcooling means for accomplishing subcooling. As well known in the art, other means could be used such as integrating the subcooling function into part of the main heat exchanger 22. It should be noted that, liquid air stream 64 can be partially subcooled within exchanger 70 prior to further subcooling in exchanger 118. It is to be noted that where a separate subcooling unit is utilized, the physical position of the exchanger may necessitate a liquid pump to motivate crude liquid oxygen back to the upper column. The refinement of the crude liquid oxygen produces an oxygen-rich liquid column bottoms 72 of the lower pressure column 30 that is partially vaporized in a condenser reboiler 74 in the bottom of the lower pressure column 30 against condensing a nitrogen-rich vapor column overhead stream 76 removed from the higher pressure column 28. The resulting nitrogen-rich liquid stream 78 is divided into first and second nitrogen-rich reflux streams 80 and 82 that serve as reflux to the higher pressure column 28 and the lower pressure column 30, respectively. Second nitrogen-rich reflux stream is subcooled within the subcooling unit 70 and is in part, as a reflux stream 84, valve expanded by an expansion valve 86 and introduced as reflux into the lower pressure column 30. Optionally, another part 88 of the second nitrogen-rich reflux stream 82 is valve expanded in an expansion valve 90 and can be taken as a nitrogen liquid product stream 92. The subcooling heat exchange duty is provided with a nitrogen-rich vapor stream 94 that is made up of column overhead from the lower pressure column 30. After having been partially warmed within the subcooling unit 70, the nitrogen-rich vapor stream is fully warmed within main heat exchanger 22 and taken as a nitrogen product stream 96.

As illustrated all or optionally, part of an oxygen-rich liquid stream 98, composed of the oxygen-rich liquid column bottoms 72 is pumped by a pump 100 to produce a pumped liquid stream 102. A first part 104 of at least part of the pumped liquid stream 102 can be heated in main heat exchanger 22 in indirect heat exchange with the first subsidiary compressed air stream 18 to produce a pressurized oxygen product stream 106. Depending upon the degree of pressurization of pumped liquid stream 102, pressurized oxygen product stream 106 will either be a supercritical fluid or will be a high pressure vapor. Optionally, a part 108 of the pumped liquid stream 102 can be valve expanded within an expansion valve 110 and taken as an oxygen-rich liquid product stream 112. As would be known to those skilled in the art, additionally or in lieu thereof, another component-rich liquid stream enriched in nitrogen could be used to form a pressurized product.

Argon column 32 operates at a pressure comparable with the lower pressure column 30 and typically will employ between 50 and 180 stages depending upon the amount of argon refinement that is desired. A gaseous argon and oxygen containing feed stream 114 is removed from the lower pressure column 30 at a point at which the argon concentration is at least near maximum and the argon and oxygen containing feed is rectified within the argon column 32 into an argon-rich vapor column overhead and an oxygen-rich liquid column bottoms. An argon-rich vapor stream 115, composed of column overhead produced in argon column 32, is condensed in an argon condenser 116 having a shell 117 and a core 118 to produce an argon-rich liquid stream 120. A part 122 of the argon-rich liquid stream 120 is returned to the argon column 32 as reflux and a part 124 is valve expanded within an expansion valve 126 and taken as an argon product stream 128. Depending on the number of stages, such argon-rich product can be further processed to remove oxygen and nitrogen in a manner known in the art. The resulting oxygen-rich and argon-lean liquid column bottoms of the argon column 32 can be taken as a stream 130, pumped by a pump 132 and then returned as an argon-lean liquid stream back 134 to the lower pressure column 30.

Crude liquid oxygen stream 68 composed of the crude liquid oxygen column bottoms 50 of the higher pressure column 28 is subcooled within subcooling unit 70, previously discussed, and then divided into first and second subsidiary crude liquid oxygen streams 138 and 140. As will be discussed, first subsidiary crude liquid oxygen stream 138 serves in the particular embodiment illustrated in FIG. 1 as the first liquid stream that will subcool the second liquid stream formed by second part 64 of liquid air stream 60 in a manner that will be discussed. The first subsidiary crude liquid oxygen stream 138 is valve expanded in an expansion valve 142 and introduced into a shell 117 housing the core 118 to condense the argon-rich vapor stream 116. This partially vaporizes first subsidiary crude liquid oxygen stream 138 and produces liquid and vapor phases. Liquid and vapor phase streams 146 and 148, that are composed of such liquid and vapor phases, respectively, are introduced into the lower pressure column 30 for further refinement of the crude liquid oxygen column bottoms 50. Additionally second subsidiary crude liquid oxygen stream 140 is valve expanded in a valve 150 and then introduced into the lower pressure column for further refinement.

The second liquid stream (part 64 of liquid air stream 60) is also introduced into the core 118 of argon condenser 116 where it is subcooled through indirect heat exchange with the first liquid stream formed by first subsidiary crude liquid oxygen stream 138. The resulting subcooled second liquid stream 152 is then valve expanded in a valve 154 and introduced into lower pressure column 30 at a location above the locations at which second subsidiary crude liquid oxygen stream 140 and the liquid and vapor phase streams 146 and 148 are introduced. Preferably, the core 118 of the argon condenser 116 is of plate-fin construction having cooling passages between parting sheets that are fed with argon-rich vapor stream 115 and the second liquid stream. The boiling passages for partially vaporizing the crude liquid oxygen containing in first subsidiary crude liquid oxygen stream 138 are open at opposite ends. The cooling passages provided within the core 118 of argon condenser 116 in which the second liquid stream is subcooled will not be adjacent to those that function to condense the argon. As a result, the subcooled second liquid stream 152 will have a temperature comparable to that of the condensed argon and the vapor flash produced at expansion valve 154 will be decreased. In such manner, the reflux rate in the lower pressure column 30 (in section 44) will be increased, the amount of oxygen and argon present in the column overhead of the lower pressure column 30 will be reduced and oxygen recovery associated with the oxygen-rich liquid column bottoms 72 and the rate at which the oxygen and argon containing stream 114 will be able to be drawn from the lower pressure column 30 therefore, will both be increased resulting in increased oxygen and argon recovery.

Figure 2:
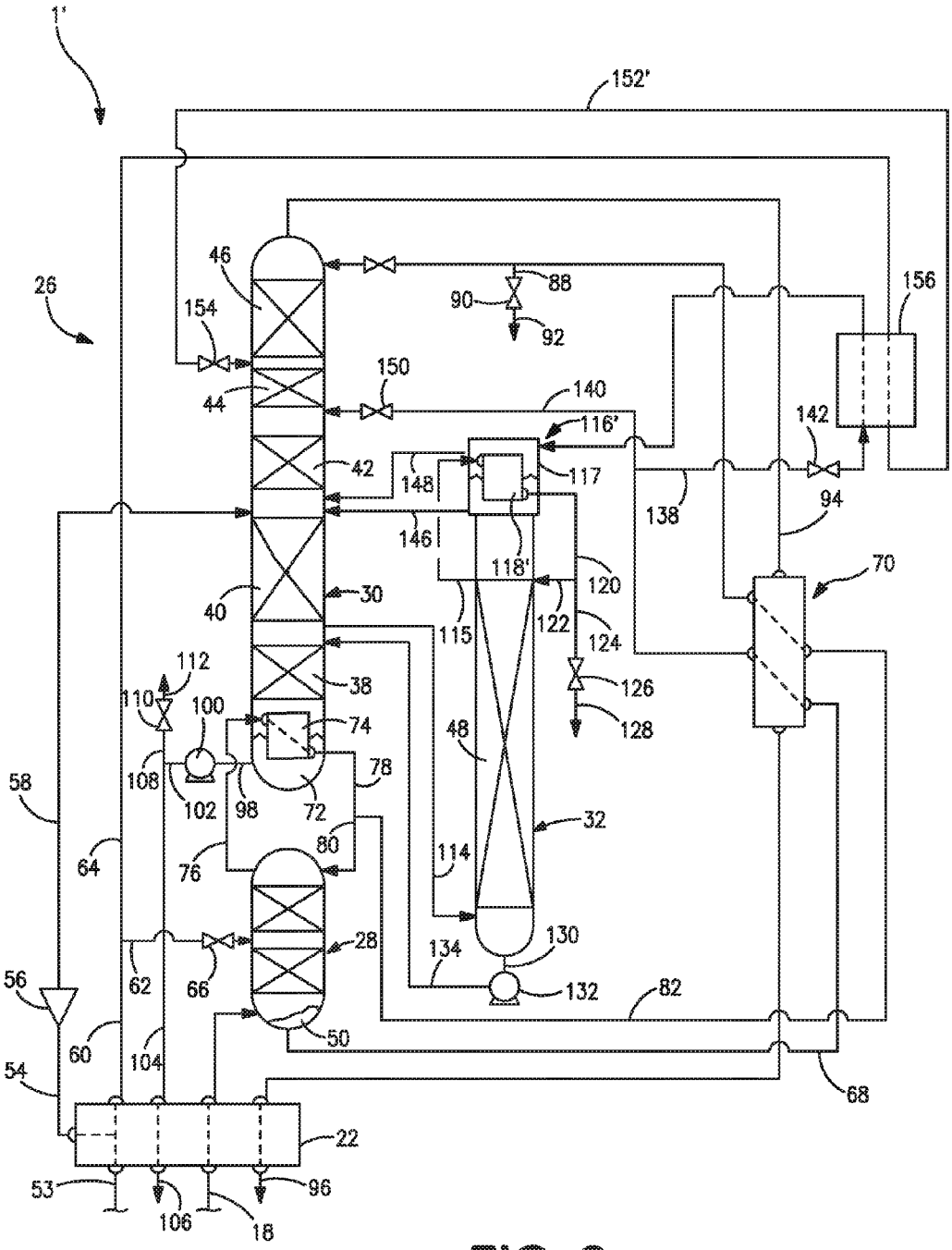
FIG. 2 is a fragmentary, schematic diagram of an alternative embodiment of an air separation apparatus for carrying out a method in accordance with the present invention in which a separate heat exchanger is used as the subcooling apparatus and the liquid stream is composed of liquid air.

In FIG. 1, the argon condenser 116 therefore, constitutes a second subcooling means having a subcooling function. With reference to FIG. 2, an air separation apparatus 1' is provided that constitutes an alternative embodiment of air separation apparatus 1 shown in FIG. 1. Air separation apparatus 1' incorporates a second means for subcooling the second liquid stream that is formed by a dedicated heat exchanger 156. The first liquid stream produced by the first subsidiary crude liquid oxygen stream 138, after expansion in expansion valve 142 is introduced into heat exchanger 156 to subcool the second liquid stream (second part 64 of the liquid air stream). The indirect heat exchange will partially vaporize the second subsidiary crude liquid oxygen stream 138 that will be further vaporized through indirect heat exchange with the argon-rich vapor stream 115. Argon condenser 116' is therefore, not provided with a separate set of cooling passages for the second liquid stream. The advantage of this embodiment is that the resulting temperature of the subcooled second liquid stream 152' will be several degrees lower than that of the condensed argon. As a result there will be even less flash off vapor produced within subcooled second liquid stream 152' as compared with subcooled second liquid stream 152 produced by air separation apparatus 1 shown in FIG. 1.

Figure 3:
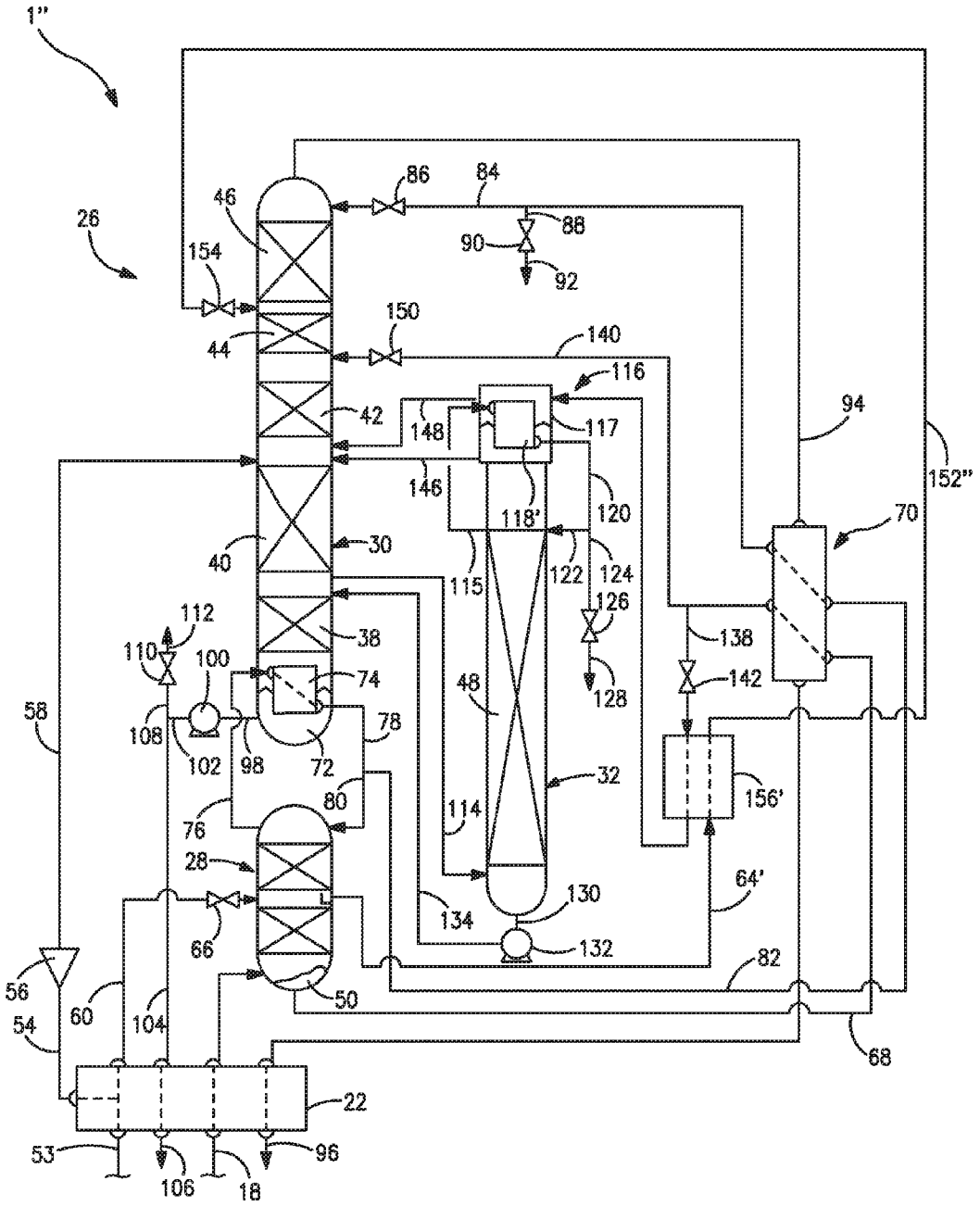
FIG. 3 is an alternative embodiment of FIG. 2 in which the liquid stream is composed of synthetic liquid air withdrawn from a higher pressure column.

With reference to FIG. 3 an air separation apparatus 1" is illustrated that constitutes an alternative embodiment of the air separation apparatus 1' shown in FIG. 2. In air separation plant 1" all of the liquid air stream 60 is introduced into the higher pressure column 28. The second liquid stream 64' is an air like stream, also known as synthetic liquid air that contains oxygen and nitrogen as well argon. The argon concentration is no less than that of air after having been purified and the oxygen content is less than the crude liquid oxygen column bottoms 50. This second liquid stream 64' is removed from a column location at or below the point at which the liquid air stream 60 is introduced into the higher pressure column 28. In the illustrated embodiment, the second liquid stream 64' is produced by removing down coming liquid from a downcomer of a tray above or from a packing section above the location of removal that physically would be at the same column location at which the liquid air stream 60 is introduced into the higher pressure column 28. As in air separation apparatus 1', a dedicated heat exchanger 156' is used as a means of subcooling the second liquid stream 64' through indirect heat exchange with a first liquid stream formed by first subsidiary crude liquid oxygen stream 138. The advantage of this arrangement, is that a portion of the flash gas generated by the liquid air is captured within the higher pressure column 28, thus increasing the liquid reflux provided by the resulting subcooled second liquid stream 152" as well as the fact that subcooled second liquid stream 152" is cooler than the subcooled second liquid stream 152 shown in FIG. 1. It is to be noted that the feed location of the second liquid stream 152" into the lower pressure column 30 can reside at a considerable height (~200 ft) and in such case, a mechanical pump will be required to motivate the liquid air into its feed location. The same consideration would apply to other embodiments of the present invention that are discussed herein.

Figure 4:
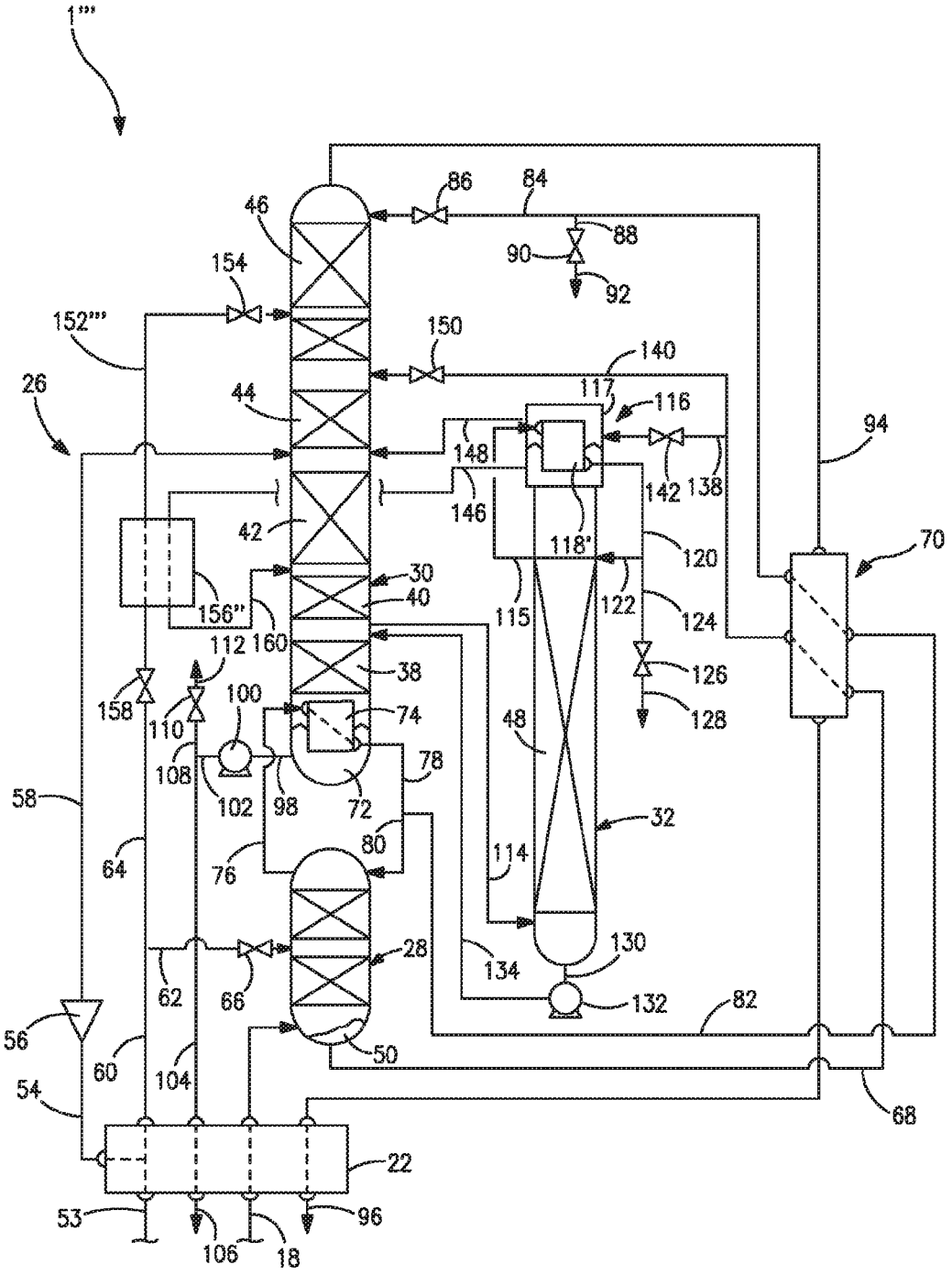
FIG. 4 is an alternative embodiment of FIG. 3 in which the liquid stream is subcooled through indirect heat exchange with a liquid phase stream that is composed of a liquid phase produced in an argon condenser associated with the argon column.

An air separation apparatus 1'" is shown in FIG. 4 in which all of the first subsidiary crude liquid oxygen is valve expanded within the expansion valve 142 and introduced into the argon condenser 116. The first liquid stream in this embodiment is formed from the liquid phase stream 146 that is discharged from the argon condenser and that indirectly exchanges heat within a dedicated heat exchanger 156" with the second liquid stream that is formed from second subsidiary liquid air stream 64 after having been partially depressurized by expansion valve 158. In this regard, if the liquefied air is at sufficient pressure, a temperature increase may be incurred upon expansion (isentropic or isenthalpic) due to the fact that the fluid is above its "inversion point". For an isenthalpic (valve) expansion, the inversion point being defined by a Joule-Thomson Coefficient ($\square_{JT}$) of zero (a negative value yields an increase in temperature upon a pressure reduction). The use of valve 158 therefore enables an increase LM□T and thus heat exchanger 156" can be made smaller and therefore, less expensive than heat exchangers 156 and 156', discussed above. Furthermore, the heat exchange results in a partial evaporation of the liquid phase stream 154 to produce a two-phase stream 160 that is introduced into the lower pressure column 30 at a location below that of the second subsidiary crude liquid oxygen stream 140 to provide additional nitrogen stripping vapor and thereby increase the separation ability of the lower pressure column 30. The resulting subcooled second liquid stream 152'" is valve expanded in expansion valve 154 and introduced into the lower pressure column 30 as in the other embodiments, discussed above.

Figure 5:
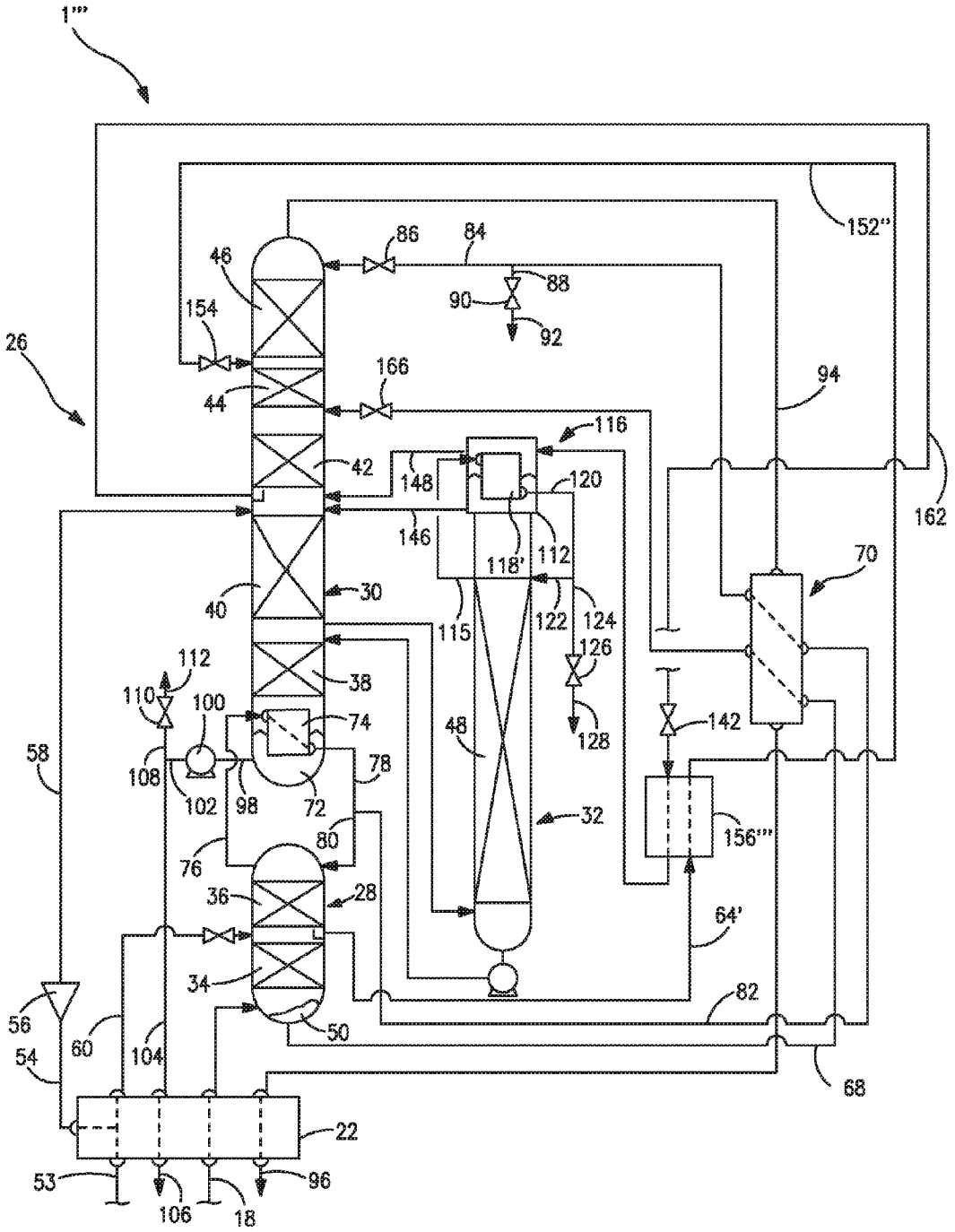
FIG. 5 is an alternative embodiment of FIG. 3 in which the liquid stream is subcooled through indirect heat exchange with a liquid stream removed from the lower pressure column.

FIG. 5 illustrates an air separation $1^{iv}$ that is similar to air separation plant 1" shown in FIG. 3. However, in air separation plant $1^{iv}$, a first liquid stream 162 is extracted from the lower pressure column 30 that would have a similar composition to the liquid phase stream 146, shown in FIG. 1. First liquid stream 162 is valve expanded within an expansion valve 164 and is partially vaporized within a dedicated heat exchanger 156'" through indirect heat exchange with the second liquid stream 64'. The first liquid stream 162 is then introduced into the argon condenser 116 where it is further vaporized. As illustrated, the liquid and vapor phase streams 146 and 148 are introduced into the lower pressure column 30 at a level thereof at which the first liquid stream 162 is withdrawn although the point of introduction of such streams could be below such level. Consequently, all of the crude liquid oxygen stream 68, after having been subcooled within the subcooling unit 70 is valve expanded within an expansion valve 166 and introduced into the lower pressure column 30 for further refinement and the resulting subcooled liquid stream 152" is introduced into the lower pressure column 30 above crude liquid oxygen stream 68.

While the present invention has been described with reference to preferred embodiments, as would occur to those skilled in the art, numerous changes, additions and omissions could be made without departing from the spirit and scope of the invention as set forth in the appended claims.

What is claimed is:

1. An air separation apparatus comprising:

a cryogenic distillation column unit having at least a higher pressure column and a lower pressure column configured to distill compressed and purified air into at least a nitrogen-rich fraction and oxygen-rich fraction, the lower pressure column operatively associated with the higher pressure column in a heat transfer relationship and connected to the higher pressure column such that a crude liquid oxygen stream produced in the higher pressure column is introduced into and further refined in the lower pressure column;

the distillation column unit further having an argon column configured to produce an argon-rich fraction stream from an oxygen and argon containing vapor stream extracted from the lower pressure column;

a main heat exchanger configured for cooling the compressed and purified air to produce a liquid air stream from a portion of the compressed and purified air wherein a portion of the liquid air stream is to be introduced into the lower pressure column;

a first subcooler configured for subcooling the crude liquid oxygen stream prior to the further refinement in the lower pressure column;

an argon condenser configured to condense the argon-rich fraction stream to produce an argon product via indirect heat exchange with a portion of the subcooled crude liquid oxygen stream and subcool the portion of the liquid air stream while in the argon condenser via indirect heat exchange with the portion of the subcooled crude liquid oxygen stream;

wherein the argon condenser is coupled to the lower pressure column and further configured to produce a liquid phase stream and a vapor phase stream from the portion of the subcooled crude liquid oxygen stream and wherein the liquid phase stream and the vapor phase stream are introduced into the lower pressure column;

wherein the portion of the liquid air stream is introduced into the lower pressure column at a column location above that at which the crude liquid oxygen stream, or any portion thereof, is introduced into the lower pressure column so that a liquid to vapor ratio below the column location into which the liquid air stream is introduced is increased and therefore, oxygen present within a column overhead of the lower pressure column is reduced and oxygen recovery of the distillation column unit is increased.

2. The air separation apparatus of claim 1, further comprising a pump connected to the distillation column unit such that at least part of a component-rich stream, enriched in a component of the air, is pumped to form a pumped liquid stream and wherein the main heat exchanger is further configured for heating at least part of the pumped liquid stream though indirect heat exchange with the compressed and purified air thereby to produce a pressurized product stream from the pumped liquid stream.

3. The air separation apparatus of claim 1 further comprising a booster compressor configured for further compressing a portion of the compressed and purified air to produce a boosted pressure air stream, and wherein the portion of the compressed and purified air cooled in the main heat exchanger to produce the liquid air stream is the boosted pressure air stream and wherein a second portion of the liquid air stream is to be introduced into the higher pressure column.

4. The air separation apparatus of claim 3 further comprising a first expansion valve disposed between the lower pressure column and the first subcooler such that a first portion of the subcooled crude liquid oxygen stream is valve expanded prior to introduction into the lower pressure column.

5. The air separation apparatus of claim 4 wherein the portion of the subcooled crude liquid oxygen stream is a second portion of the subcooled crude liquid oxygen stream and the air separation apparatus further comprising a second expansion valve disposed between the first subcooler and the argon condenser such that the second portion of the subcooled crude liquid oxygen stream is valve expanded prior to being introduced into the argon condenser.

6. The air separation apparatus of claim 5 further comprising a third expansion valve disposed between the argon condenser and the lower pressure column such that the subcooled liquid air stream is valve expanded prior to being introduced into the lower pressure column.

* * * * *